US006397028B1

(12) United States Patent
Nakamura

(10) Patent No.: US 6,397,028 B1
(45) Date of Patent: May 28, 2002

(54) IMAGE FORMING APPARATUS WITH INTERMEDIATE CONVEYING PATH POSITIONED RELATIVE TO SIDE-MOUNTED AFTER-TREATMENT UNIT AND HAVING SLIDABLE TOP COVER

(75) Inventor: Takeshi Nakamura, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/688,667

(22) Filed: Oct. 16, 2000

(30) Foreign Application Priority Data

Oct. 27, 1999 (JP) ..... 11-304761

(51) Int. Cl.[7] ..... B65H 29/58; G03G 15/00
(52) U.S. Cl. ..... 399/124; 399/405
(58) Field of Search ..... 399/405, 21, 124, 399/407, 404, 402

(56) References Cited

U.S. PATENT DOCUMENTS 5,101,240 A * 3/1992 Pendell et al. ..... 399/405

FOREIGN PATENT DOCUMENTS

JP 7-33304 * 2/1995
JP 9-301602 11/1997

* cited by examiner

*Primary Examiner*—Quana M Grainger
(74) *Attorney, Agent, or Firm*—Renner, Otto, Boisselle & Sklar

(57) ABSTRACT

An object of the present invention is to solve the following problem of an image forming apparatus in which a sheet-of-paper conveying path cover is disposed so as to be swingable. In the case where a recording-sheet accommodating unit having at least one or more sheet-of-paper discharging trays is mounted above an apparatus main body, the lowermost sheet-of-paper discharging tray hinders the conveying path cover from swinging and large space for upward swing of the conveying path cover cannot be ensured. Accordingly an intermediate conveying path is difficult of access for coping with a jam. A sheet-of-paper discharging section is disposed in an upper portion of the apparatus main body, an intermediate conveying unit which conveys a sheet of paper to a finisher mounted on a side of the apparatus main body is disposed in an upper portion of the apparatus main body, a mailbox is mounted above the apparatus main body, and conveying path covers which cover the intermediate conveying unit are disposed so as to be slidable on the top face of the apparatus main body.

6 Claims, 7 Drawing Sheets

IMAGE FORMING APPARATUS WITH INTERMEDIATE CONVEYING PATH POSITIONED RELATIVE TO SIDE-MOUNTED AFTER-TREATMENT UNIT AND HAVING SLIDABLE TOP COVER

BACKGROUND OF THE INVENTION

1. Field of the Invention

The present invention relates to an image forming apparatus in which an image forming section is disposed in an apparatus main body, a recording-paper discharging section for discharging a recording sheet on which an image is formed by the image forming section, to the outside of the apparatus main body is disposed in an upper portion of the apparatus main body, an intermediate conveying path for conveying a recording sheet from the recording-paper discharging section to an after-treatment unit mounted on the side of the apparatus main body is disposed above the image forming section in an upper portion of the apparatus main body, and a recording-sheet accommodating unit having a recording-paper discharging tray, or a document reading apparatus can be mounted above the apparatus main body.

2. Description of the Related Art

In recent years, with regard to an image forming apparatus, a system provided with a conveying path in a nearly vertical direction is currently becoming mainstream. That is to say, the system comprises an image forming section disposed in a central portion of an apparatus main body, a recording-paper feeding section disposed below the image forming section, and a recording-paper discharging section disposed in an upper portion of the apparatus main body, for discharging a recording sheet (a sheet of paper) which is fed from the recording-paper feeding means to the image forming section, after image formation, wherein the recording sheet is discharged to a recording-paper discharging tray mounted above the apparatus main body in a facedown state where an image-formed face of the recording-paper is placed face down.

The reason why such construction is used is as follows. Since a recording-sheet conveying path can be very short, and moreover, it is possible to open most part of the conveying path only by opening the side face of the apparatus, output time from recording-paper feeding to recording-paper discharging is short, conveying of recording-sheets and coping with a jam can be carried out very easily.

However, on the other hand, it is difficult to mount both an after-treatment unit such as a finisher and a recording-sheet accommodating unit such as a mailbox.

The reason is as follows. The recording-sheet accommodating unit such as a mailbox is mounted above the apparatus main body in general. It, however, is very difficult to make space for mounting the recording-sheet accommodating unit above the apparatus.

In this connection, in order to make it possible to mount both a recording-sheet accommodating unit and an after-treatment unit, there is provided an apparatus which comprises an intermediate conveying path, disposed in an upper portion of an apparatus main body (above an image forming section), for conveying a recording sheet to an after-treatment unit which is mounted on a side of the apparatus main body.

However, even in the apparatus comprising an intermediate conveying path disposed in the upper portion of an apparatus main body, a recording sheet jam occurs in the intermediate conveying path. Therefore, as described in Japanese Unexamined Patent publication JP-A 9-301602 (1997), there is proposed an apparatus comprising a swingable conveying path cover disposed on the top face of the apparatus main body, for covering an intermediate conveying path.

Further, there is proposed an apparatus comprising an intermediate conveying path which is disposed so as to be pulled out of an apparatus main body.

The apparatus comprising the conveying path cover disposed so as to be swingable has the following problem. In the case where a recording-paper accommodating unit which has at least one or more recording-paper discharging trays, or a document reading apparatus is mounted above the apparatus main body, the lowermost recording-paper discharging tray hinders the intermediate conveying path cover from swinging and large space for upward swing of the conveying path cover cannot be ensured. Accordingly the intermediate conveying path is difficult of access for coping with a jam.

Further, the apparatus comprising an intermediate conveying path disposed so as to be pulled out of the apparatus main body has the following problem. In the case where a recording sheet jams between the apparatus main body and the intermediate conveying path, that is, between a recording-paper discharging roller of the apparatus main body and a conveying roller of the intermediate conveying path, both ends thereof get caught in the recording-paper discharging roller and a recording-paper feeding roller, so that the intermediate conveying path cannot be pulled out. If the intermediate conveying path is forcefully pulled out, the recording sheet would be broken.

SUMMARY

The invention was made in view of the above-mentioned problems and an object of the invention is to provide an image forming apparatus comprising a recording-sheet accommodating unit and a document reading apparatus, which are disposed above an apparatus main body thereof and further comprising an intermediate conveying path disposed in an upper portion of the apparatus main body, for conveying a recording sheet on which an image is formed, to an after-treatment unit, which intermediate conveying path enables attachment of the after-treatment unit to the image forming apparatus, wherein a conveying path cover for covering the intermediate conveying path is slidably disposed, whereby a large open space is ensured to cope with a jam, with the result that high workability can be attained.

In order to attain the above object, the invention provides an image forming apparatus comprising an apparatus main body; an image forming section disposed in the apparatus main body; a recording-paper discharging section disposed in an upper portion of the apparatus main body, for discharging a recording sheet on which an image is formed by the image forming section, to an outside of the apparatus main body; and an intermediate conveying path disposed above the image forming section and on, the apparatus main body, for conveying the recording sheet from the recording-paper discharging section to an after-treatment unit to be mounted on a side of the apparatus main body, the apparatus having such a structure that a recording-sheet accommodating unit having a sheet-of-paper discharging tray, or a document reading apparatus is allowed to be mounted above the apparatus main body, and further comprising: a conveying path cover disposed so as to be slidable on a top face of the apparatus main body, for covering the intermediate conveying path.

According to the invention, in the case where a jam occurs in the intermediate conveying path, it is possible to slide the conveying path cover and open the upper portion of the intermediate conveying path without being obstructed by the recording-sheet accommodating unit or the document reading apparatus mounted above the apparatus main body. Therefore, it is possible to obtain a large open space (working space) on the top face of the intermediate conveying path, to cope with a jam with ease and enhanced workability.

In the image forming apparatus of the invention it is preferable that the conveying path cover is divided into two or more and disposed so as to be slidable in a recording-sheet conveying direction in the intermediate conveying path.

According to the invention, in the case where the recording-sheet: accommodating unit is mounted above the apparatus main body, the recording-paper discharging tray of the recording-sheet accommodating unit is inclined upward on the downstream side in a recording-sheet discharging direction in the recording-sheet accommodating unit. Therefore, by sliding the conveying path cover in the recording-sheet conveying direction, it is possible to obtain a large open space (working space) above the intermediate conveying path, to cope with a jam with ease and enhanced workability.

In the image forming apparatus of the invention it is preferable that the conveying path cover is divided in two or more and disposed so as to be slidable in a direction orthogonal to the recording-sheet conveying direction.

According to the invention, in the case where the document reading apparatus is mounted above the apparatus main body, a gap between the apparatus main body and the document reading apparatus is uniform regardless of recording-sheet conveying direction. Therefore, by sliding the conveying path cover in the direction orthogonal to the recording-sheet conveying direction, it is possible to open the intermediate conveying path on the front side of the apparatus main body, to cope with a jam with ease and enhanced workability.

The invention provides an image forming apparatus comprising an apparatus main body; an image forming section disposed in the apparatus main body; a recording-paper discharging section disposed in an upper portion of the apparatus main body, for discharging a recording sheet on which an image is formed by the image forming section, to an outside of the apparatus main body; and an intermediate conveying path disposed above the image forming section and on the apparatus main body, for conveying the recording sheet from the recording-paper discharging section to an after-treatment unit to be mounted on a side of the apparatus main body, the apparatus having such a structure that a recording-sheet accommodating unit having a sheet-of-paper discharging tray, or a document reading apparatus is allowed to be mounted above the apparatus main body, and further comprising: a conveying path cover disposed so as to be slidable on a top face and front face of the apparatus main body, for covering at least part of the intermediate conveying path.

According to the invention, by sliding the conveying path cover, it is possible to open a part of the intermediate conveying path on the top face and front face of the apparatus main body to obtain a large open space (working space). Moreover, since the front side of the intermediate conveying path is opened even in the case where a gap between the recording-sheet accommodating unit or document reading apparatus mounted above the apparatus main body is very small, it is possible to cope with a jam with ease and enhanced workability.

In the image forming apparatus of the invention it is preferable that at least part of the conveying path cover comprises a transparent member.

According to the invention, it is possible to visually check a state of conveying a recording sheet in the intermediate conveying path. Therefore, it is possible to cope with a jam after checking a jamming position in the intermediate conveying path, with enhanced workability.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
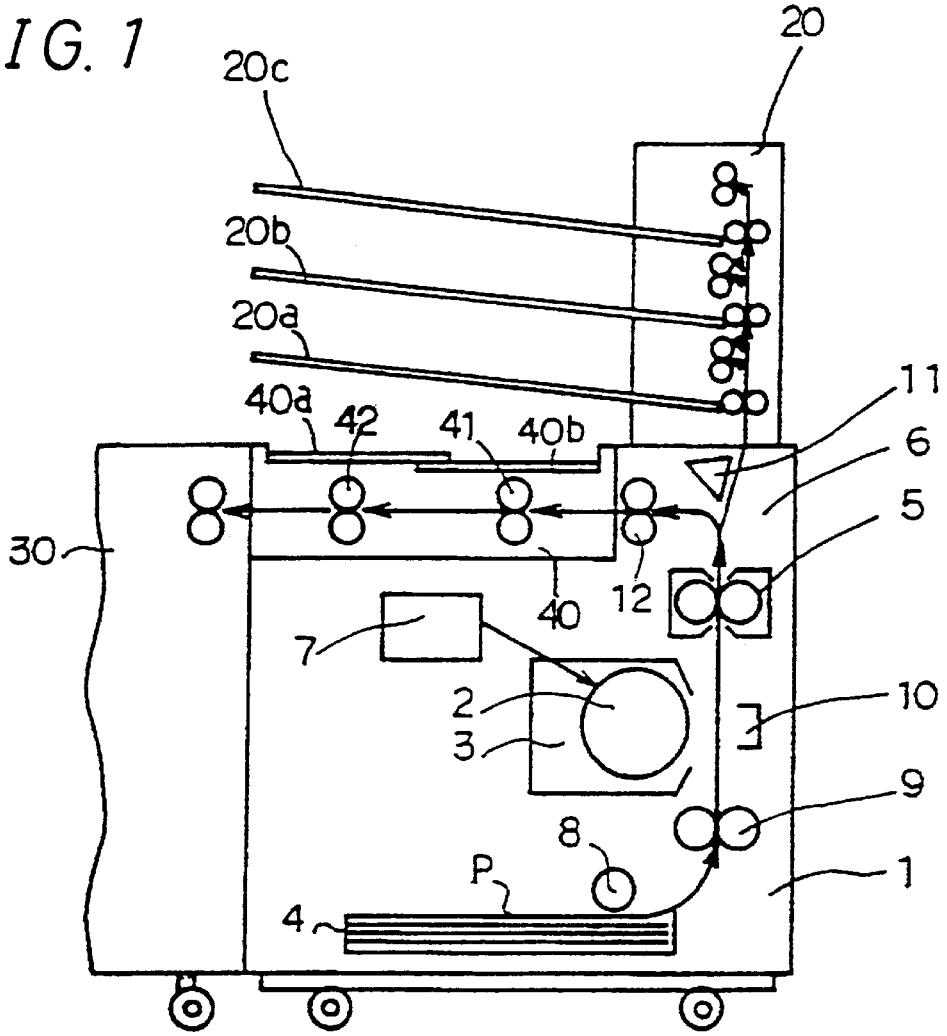
FIG. 1 is a schematic section view showing a first embodiment of an image forming apparatus according to the present invention.
Figure 2:
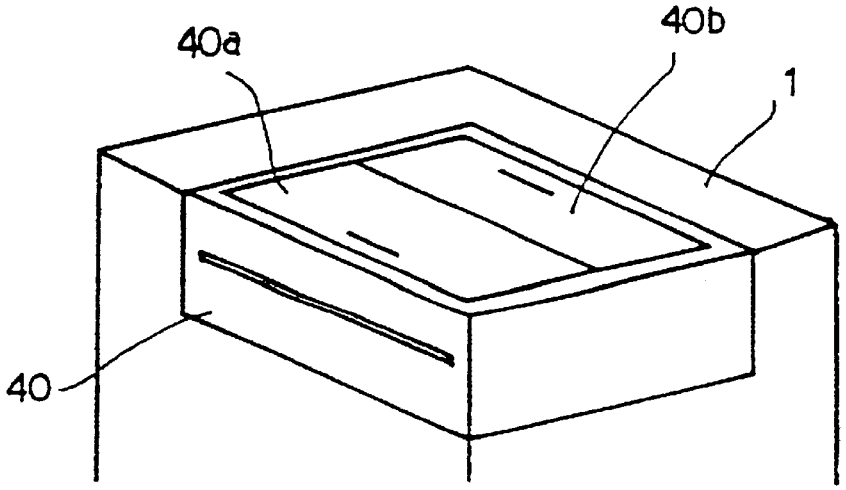
FIG. 2 is a perspective view showing a state before opening a conveying path cover in the image forming apparatus of the first embodiment.
Figure 3:
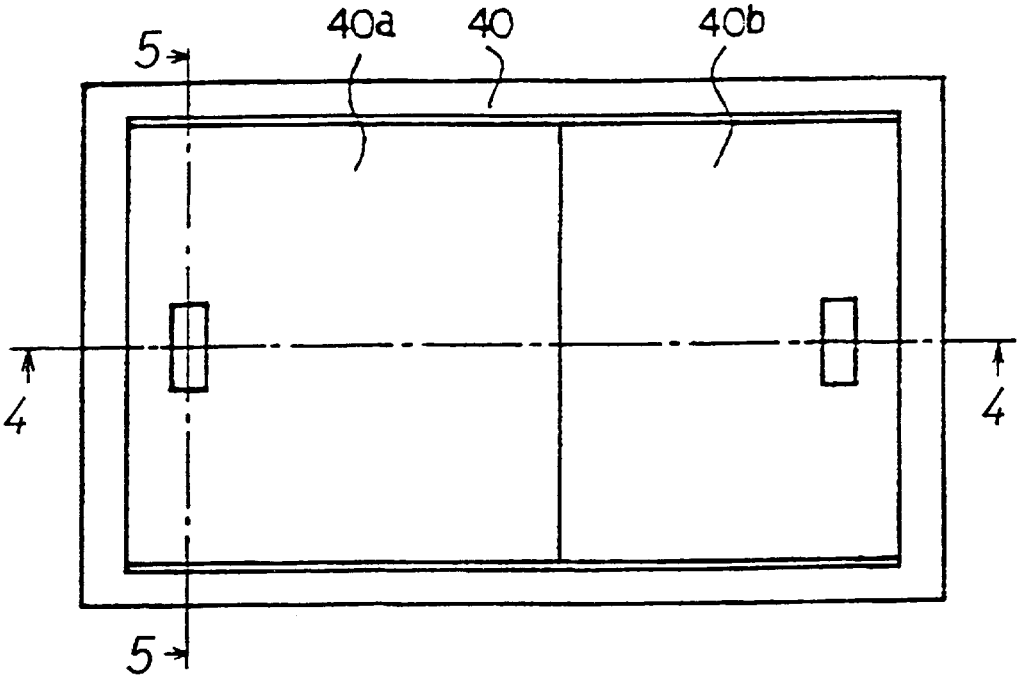
FIG. 3 is a plan view showing an intermediate conveying unit of FIG. 2.
Figure 4:
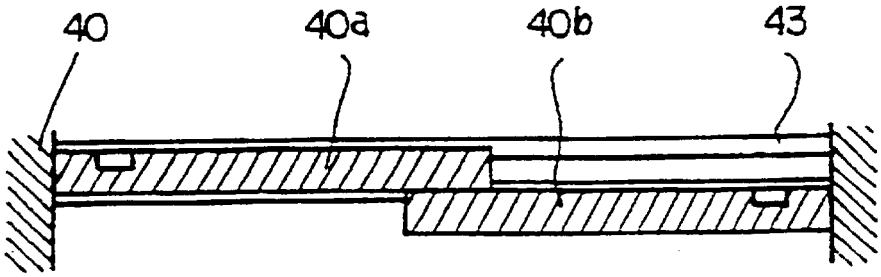
FIG. 4 is a section view taken on line A—A of FIG. 3.
Figure 5:
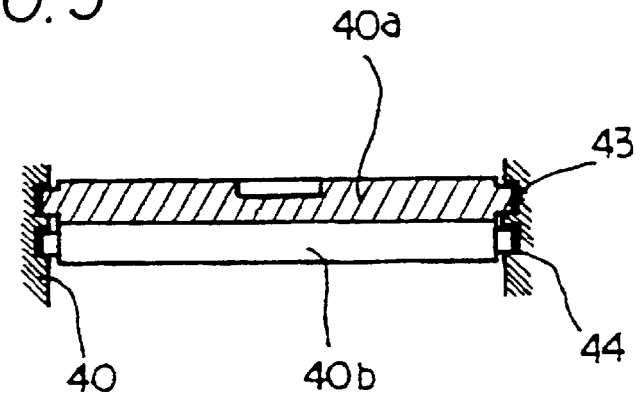
FIG. 5 is a section view taken on line B—B of FIG. 3.
Figure 6:
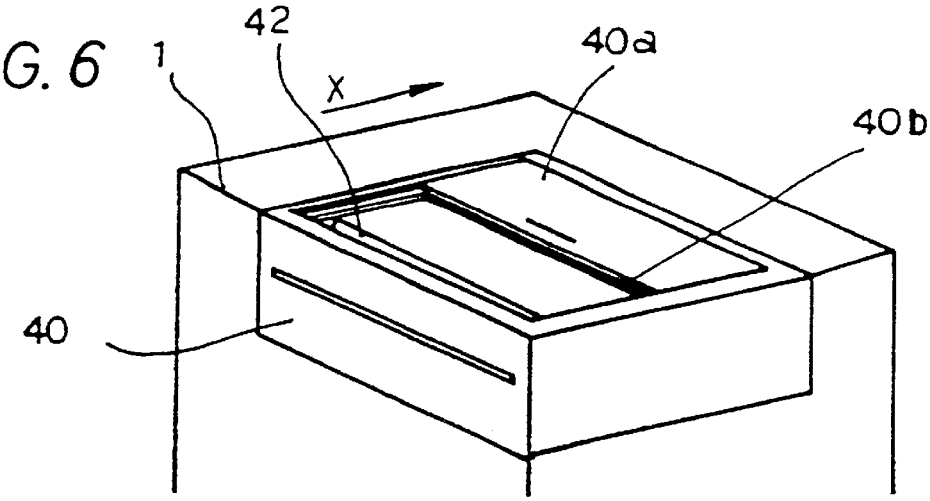
FIG. 6 is a perspective view showing an open state of the conveying path cover in the image forming apparatus of the first embodiment.
Figure 7:
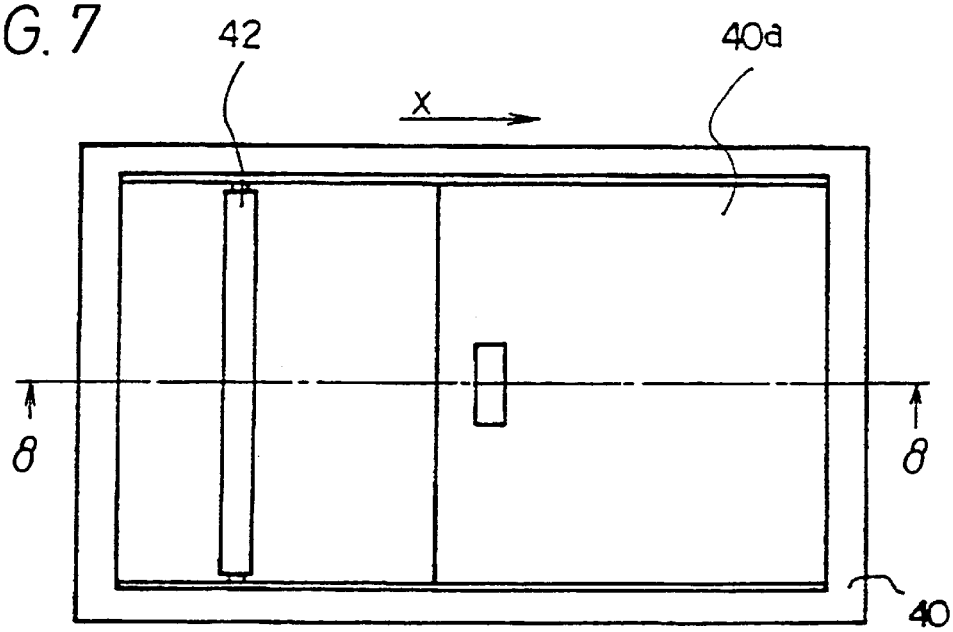
FIG. 7 is a plan view showing an intermediate conveying unit of FIG. 6.
Figure 8:
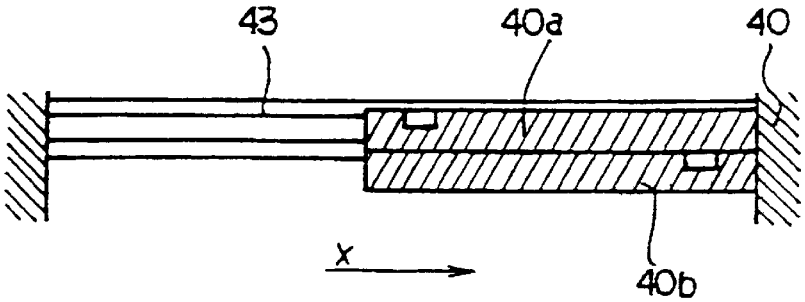
FIG. 8 is a section view taken on line C—C of FIG. 7.

Now referring to the drawings, preferred embodiments of the invention are described below.

A first embodiment of an image forming apparatus according to the present invention will be explained referring to FIGS. 1–8.

FIG. 1 is a schematic section view of an image forming apparatus of a first embodiment. An image forming section 3 which has a photoconductor drum 2 and so on is mounted nearly in the center of an apparatus main body 1. About the image forming section 3, a sheet-of-paper feeding cassette 4 is disposed below the image forming section, and a fixing unit 5 and a sheet-of-paper discharging section 6 are disposed above the image forming section.

To the image forming section 3, a writing unit 7 which irradiates the photoconductor drum 2 with laser light based on image data and forms an electrostatic latent image is disposed.

The sheet-of-paper feeding cassette 4, where sheets of paper P as recording sheets are stored, is equipped with a sheet-of-paper feeding roller 8 which feeds the sheets of paper P one by one, and a registration roller 9 which feeds a sheet of paper P fed by the sheet-of-paper feeding roller 8 to the image forming section 3 while matching a timing so that a toner image formed on the surface of the photoconductor drum 2 coincides with the edge of an image forming area of the sheet of paper P.

A transfer unit 10 which transfers the toner image formed on the photoconductor drum 2 to the sheet of paper P is disposed at a position opposed to the photoconductor drum 2. Above the transfer unit 10, the fixing unit 5 and the sheet-of-paper discharging section 6 are mounted in this order. On the side of the apparatus main body 1, a conveying path for the sheet of paper P is formed from below to above.

Above the apparatus main body 1, a mailbox 20 is mounted, which is a recording-sheet accommodating unit having one or more sheet-of-paper discharging trays 20*a*, 20*b*, 20*c* for storing the sheet of paper P discharged from the sheet-of-paper discharging section 6.

Further, on the side of the apparatus main body 1 opposite to the side where the conveying path is disposed, a finisher 30 is mounted, which is an after-treatment unit for subjecting the sheet of paper P to an after-treatment.

In the upper portion of the apparatus main body 1 (above the image forming section 3 and the writing unit 7), an intermediate conveying unit 40 is disposed, which is an intermediate conveying path for conveying the sheet of paper P discharged from the sheet-of-paper discharging section 6 to the finisher 30.

In the intermediate conveying unit 40, intermediate conveying rollers 41, 42 for conveying the sheet of paper P discharged from the sheet-of-paper discharging section 6 are disposed. On the top face of the intermediate conveying unit 40, that is, on the top face of the apparatus main body 1, conveying path covers 40*a*, 40*b* divided in two or more for covering the top face of the intermediate conveying unit 40 and opening the said top face are disposed so as to be slidable in a direction along a sheet-of-paper conveying direction in the intermediate conveying unit 40.

In the intermediate conveying unit 40, an upper guide 43 and a lower guide 44 which guide the conveying path covers 40*a*, 40*b* so as to be slidable are disposed. The upper guide 43 and the lower guide 44 guides the conveying path cover 40*a* and the conveying path cover 40*b*, respectively, so as to be slidable.

The sheet-of-paper discharging section 6 is equipped with a changeover section 11 which changes over the sheet-of-paper P conveying direction between the side of the mailbox 20 and the side of the finisher 30, and a conveying roller 12 which conveys a sheet of paper P whose conveying direction is changed over to the side of the finisher 30, to the intermediate conveying unit 40.

When an image is formed in the image forming apparatus of the above configuration, the writing unit 7 irradiates the photoconductor drum 2 with laser light modulated based on image data outputted from an image processing section, which is not shown, and forms an electrostatic latent image by a photoconductive action on the surface of the photoconductor drum 2.

Before rotation of the photoconductor drum 2, the sheets of paper P stored in the sheet-of-paper feeding cassette 4 are fed one by one to the conveying path by rotation of the sheet-of-paper feeding roller 8, and a sheet of paper P having been fed is on standby in a state where the front end thereof abuts the registration roller 9.

The registration roller 9 starts to rotate with such a timing that the front end of an image forming area of the sheet of paper P coincides with the front end of the toner image formed on the surface of the photoconductor drum 2 between the photoconductor drum 2 and the transfer unit 10, and conveys the sheet of paper P to a toner image transferring section of the transfer unit 10, where the toner image formed on the photoconductor drum 2 is transferred to the sheet of paper P.

Subsequently, the sheet of paper P on which an unfixed toner image has been transferred is conveyed to the fixing unit 5, and heated and pressurized while passing through a pair of fixing rollers of the fixing unit, whereby the unfixed toner image is melted and fixed to the sheet of paper P.

The sheet of paper P to which the image has been fixed is conveyed to the mailbox 20 or the intermediate conveying unit 40 by the changeover section 11 of the sheet-of-paper discharging section 6. A sheet of paper P conveyed to the mailbox 20 is discharged to the corresponding one of the sheet-of-paper discharging trays 20*a*, 20*b*, 20*c*. On the other hand, a sheet of paper P sent to the intermediate conveying unit 40 is conveyed to the finisher 30 through the intermediate conveying unit 40, and subjected to an after-treatment such as stapling or punching.

In such an image forming apparatus with the mailbox 20 mounted above, in order to lower the height of the whole image forming apparatus as much as possible so as to avoid decrease of the utility, a gap between the top face of the apparatus main body 1, that is, the intermediate conveying unit 40 and the lowermost sheet-of-paper discharging tray 20*a* of the mailbox 20 becomes very narrow space. However, by sliding the conveying path covers 40*a*, 40*b* of the intermediate conveying unit 40, for example, by sliding the conveying path cover 40*a* nearly horizontally in the direction of an arrow X, which is rightward in FIGS. 7 and 8, from states of FIGS. 2–5 to states of FIGS. 6–8, it is possible to enlarge the opening area of the top face of the intermediate conveying unit 40 (above the intermediate conveying roller 42). Therefore, in the case where a jam occurs at the intermediate conveying roller 42 of the intermediate conveying unit 40, it is possible to make large open space for settling the jam, and increase workability on settling the jam.

Further, in the case where a jamming point in the intermediate conveying unit 40 is on the side of the intermediate conveying roller 41, it is possible to open from above the intermediate conveying roller 41 by sliding the conveying path cover 40*b* in a direction opposite to the arrow X, Therefore, it is possible to cope with a jam at the intermediate conveying roller 41 with ease.

Figure 9:
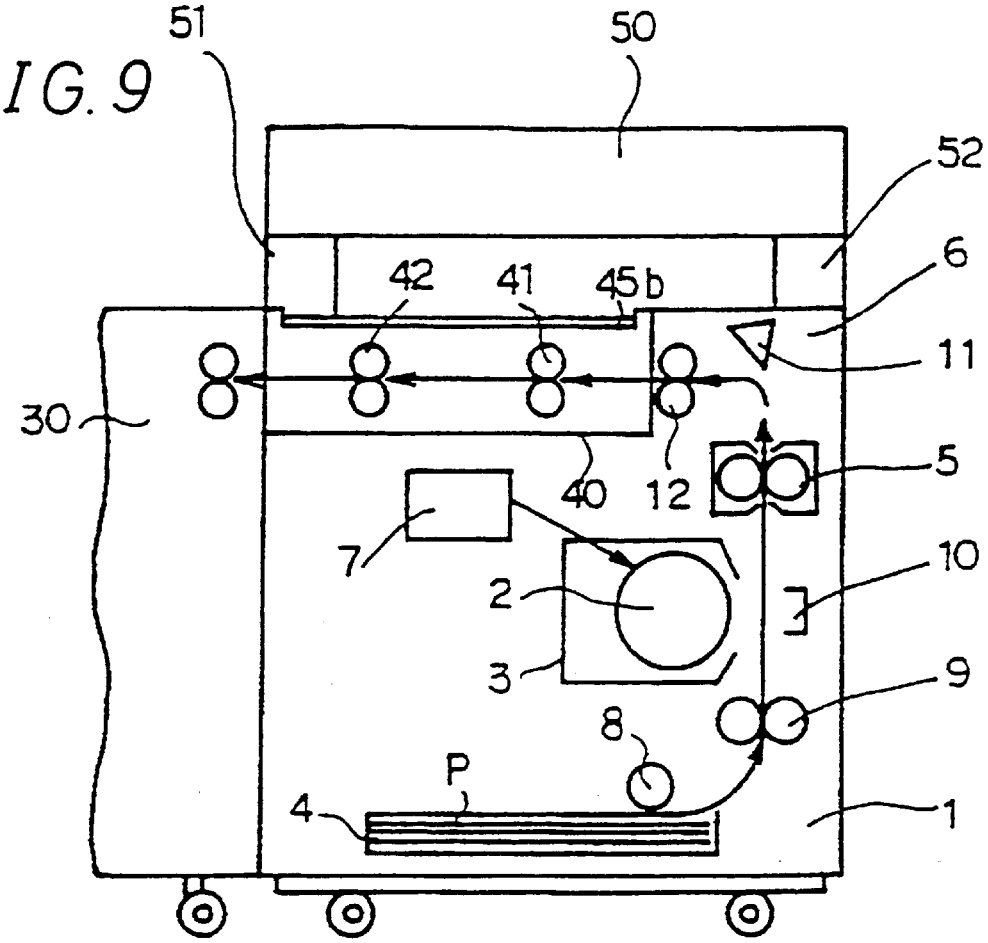
FIG. 9 is a schematic section view showing a second embodiment of an image forming apparatus according to the invention.
Figure 10:
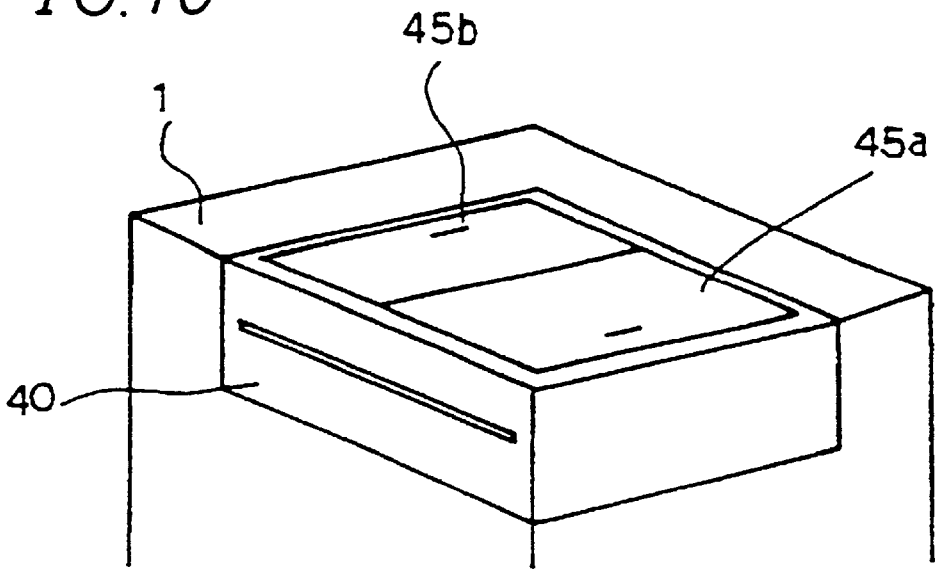
FIG. 10 is a perspective view showing a state before opening a conveying path cover in the image forming apparatus of the second embodiment.
Figure 11:
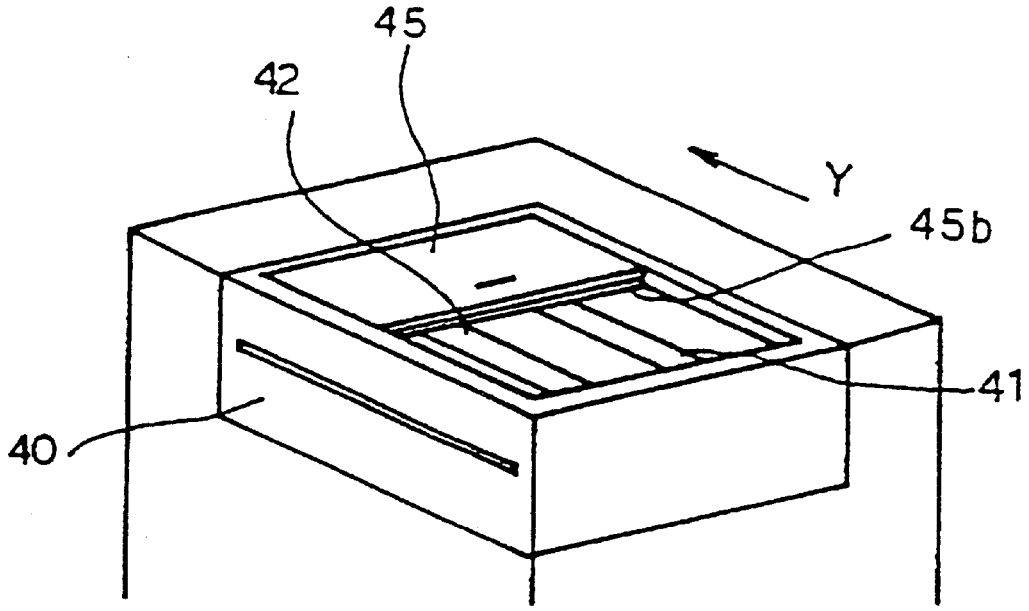
FIG. 11 is a perspective view showing an open state of the conveying path cover in the image forming apparatus of the second embodiment.
Figure 12:
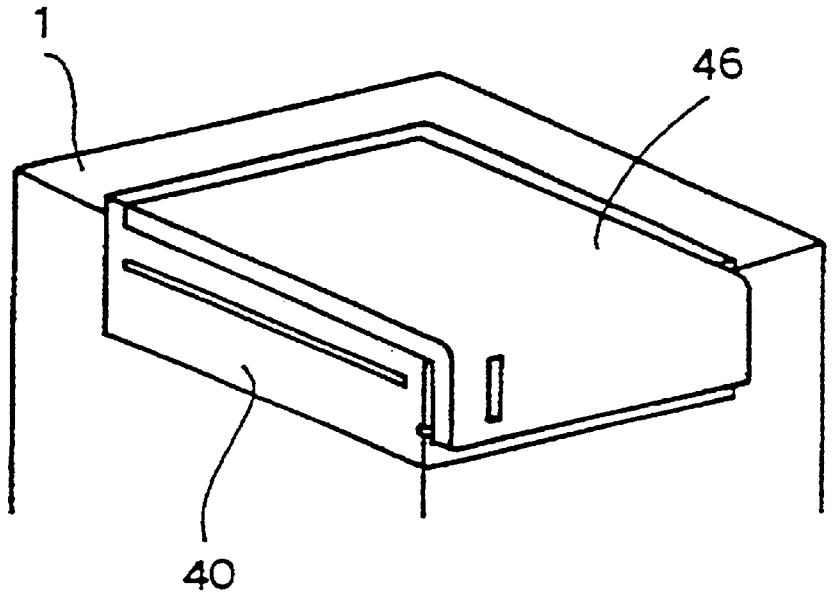
FIG. 12 is a perspective view showing a state before opening a conveying path cover in a third embodiment of an image forming apparatus according to the invention.
Figure 13:
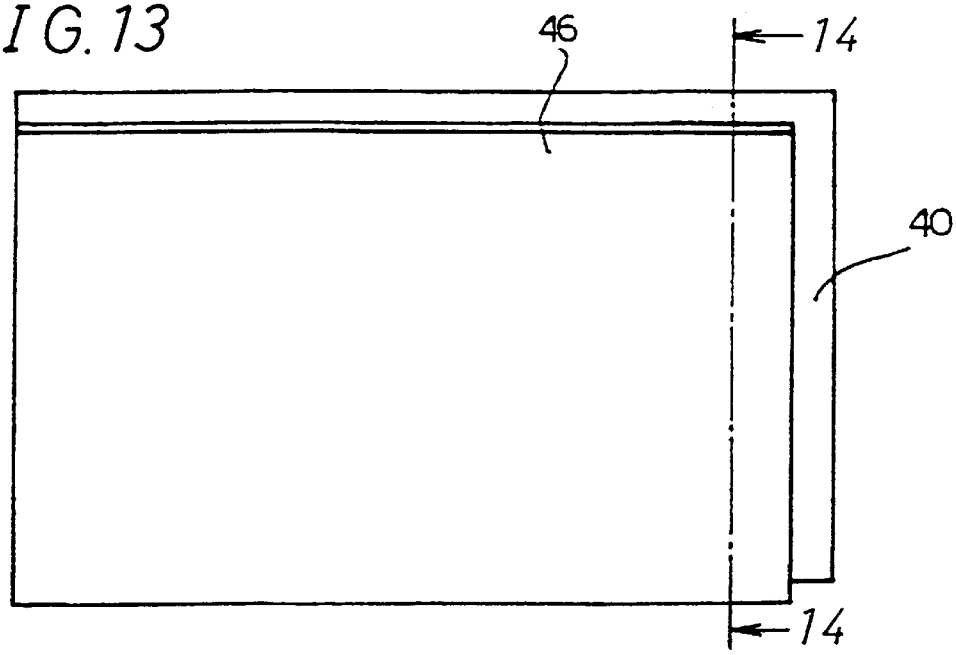
FIG. 13 is a plan view showing an intermediate conveying unit of FIG. 12.
Figure 14:
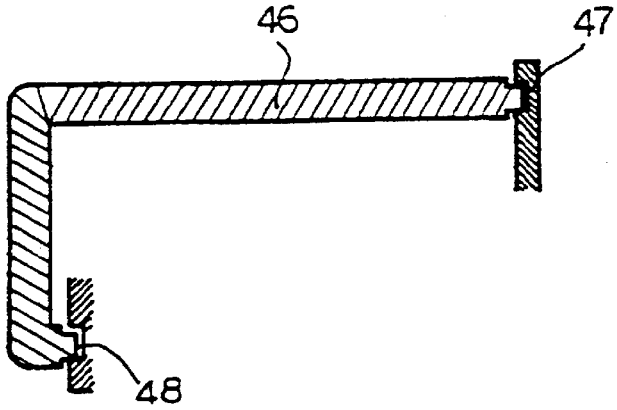
FIG. 14 is a section view taken on line D—D of FIG. 13.

A second embodiment of an image forming apparatus according to the invention will be explained referring to FIGS. 9–11.

In the image forming apparatus of the second embodiment, instead of the mailbox 20 of the first embodiment, a scanner 50, which is a document reading apparatus, is supported by supporting members 51, 52 and mounted above an apparatus main body 1.

Conveying path covers 45*a*, 45*b* of an intermediate conveying unit 40 are disposed so as to be slidable in a direction orthogonal to the sheet-of-paper P conveying direction in the intermediate conveying unit 40.

In such an apparatus that the scanner 50 is mounted above the apparatus main body 1, a gap between the scanner 50 and the top face the apparatus main body 1 (the intermediate conveying unit 40) becomes uniform in the sheet-of-paper P conveying direction. Since the conveying path covers 45*a*, 45*b* are disposed so as to be slidable in the direction orthogonal to the sheet-of-paper P conveying direction, it is possible to slide the conveying path cover 45*a* nearly horizontally in the direction of an arrow Y shown in FIG. 11 and thereby largely opening the top face of the intermediate conveying unit 40 on the front side of the apparatus main body 1. Therefore, it is possible to cope with a jam at intermediate conveying rollers 41, 42 with ease.

A third embodiment of an image forming apparatus according to the invention will be explained referring to FIGS. 12–15.

In the image forming apparatus of the third embodiment, a conveying path cover 46 is formed so as to cover the top face and the front side of an intermediate conveying unit 40 and open the said top face and the said front side. The conveying path cover 46 is disposed so as to be guided and slid by a top-face guide 47 and a front-face guide 48 along the sheet-of-paper P conveying direction.

Figure 15:
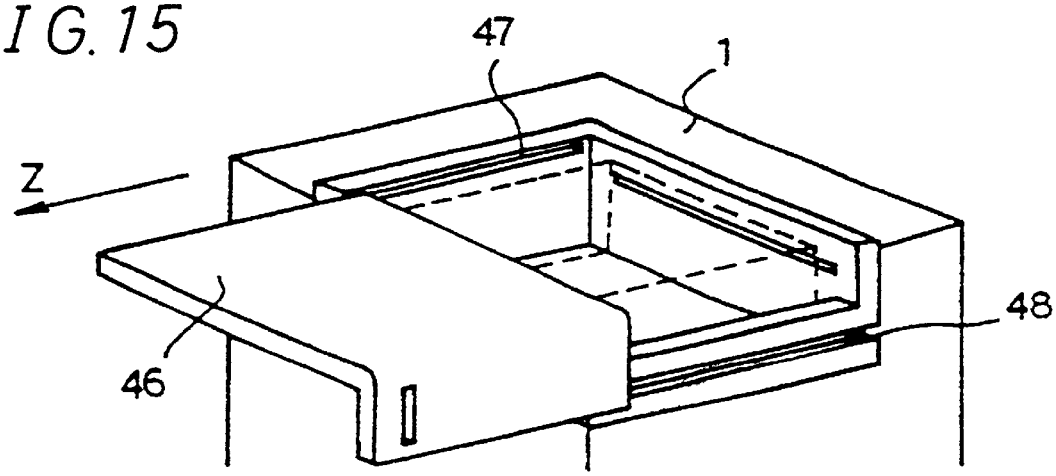
FIG. 15 is a perspective view showing an open state of the conveying path cover in the third embodiment of an image forming apparatus according to the invention.

When such a conveying path cover 46 is slid nearly horizontally in the direction of an arrow Z as shown in FIG. 15, the top face and the front side of the intermediate conveying unit 40 shown by a broken line in FIG. 15 are opened. Therefore, even in the case where a gap between the apparatus main body 1 and a mailbox or a scanner mounted above, it is possible to cope with a jam from the front side of the intermediate conveying unit 40, so that it is possible to cope with a jam in the intermediate conveying unit 40 with ease.

Figure 16:
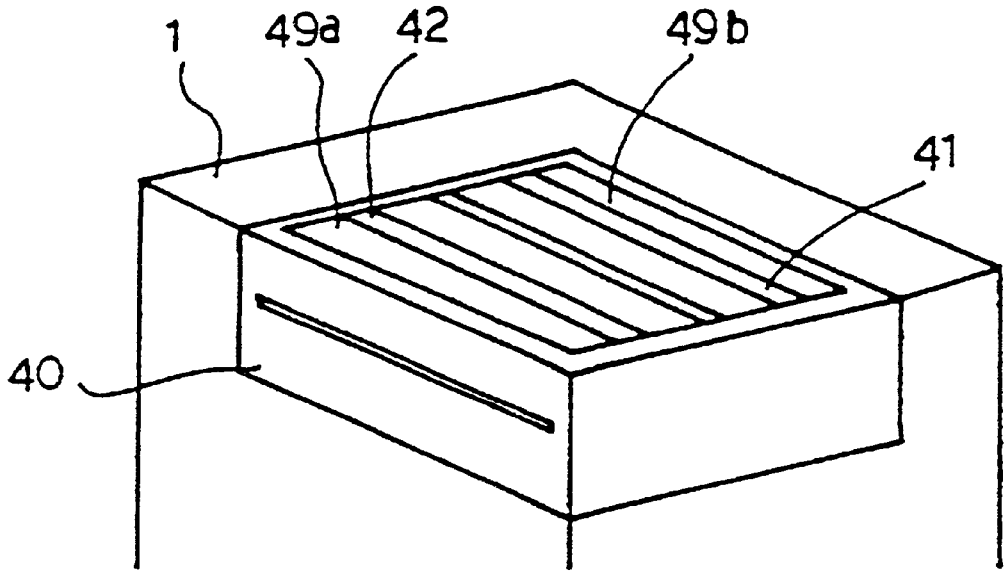
FIG. 16 is a perspective view showing a state before opening a conveying path cover in a fourth embodiment of an image forming apparatus according to the invention.
Figure 17:
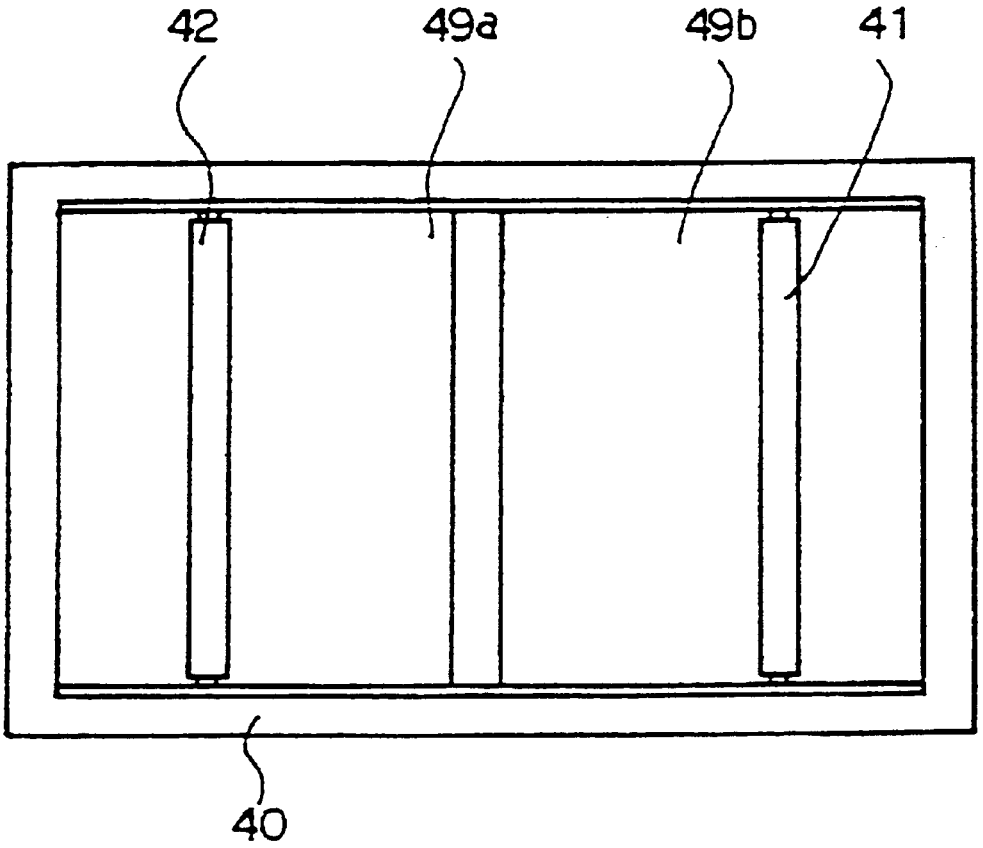
FIG. 17 is a plan view showing an intermediate conveying unit of FIG. 16.

A fourth embodiment of an image forming apparatus according to the invention will be explained referring to FIGS. 16 and 17.

Conveying path covers 49*a*, 49*b* of the image forming apparatus of the fourth embodiment are disposed so as to be slidable in a direction along the sheet-of-paper P conveying direction as in the first embodiment. The conveying path covers 49*a*, 49*b* are made of a transparent member.

Therefore, a conveying state of the sheet of paper P in an intermediate conveying unit 40, that is, presence of a jam and a jamming position can be visually checked with ease without opening the conveying path covers 49*a*, 49*b*, so that a jam of the sheet of paper P can be coped with easily.

Further, with regard to the conveying path covers 49*a*, 49*b*, at least part thereof, that is, a portion thereof enough to visually check a jamming position in the intermediate conveying unit 40 needs to be made of a transparent member.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an apparatus main body;

an image forming section disposed in the apparatus main body;

a sheet-of-paper discharging section disposed in an upper portion of the apparatus main body, for discharging a recording sheet on which an image is formed by the image forming section, to an outside of the apparatus main body; and an intermediate conveying path disposed above the image forming section and on the apparatus main body, for conveying the recording sheet from the sheet-of-paper discharging section to an after-treatment unit to be mounted on a side of the apparatus main body, the apparatus having such a structure that a recording-sheet accommodating unit having a sheet-of-paper discharging tray, or a document reading apparatus is allowed to be mounted above the apparatus main body, and further comprising:

a conveying path cover disposed so as to be slidable on a top face of the apparatus main body, for covering the intermediate conveying path.

2. The image forming apparatus of claim 1, wherein the conveying path cover is divided into two or more and disposed so as to be slidable in a recording-sheet conveying direction in the intermediate conveying path.

3. The image forming apparatus of claim 1, wherein the conveying path cover is divided in two or more and disposed so as to be slidable in a direction orthogonal to the recording-sheet conveying direction.

4. An image forming apparatus comprising:

an apparatus main body;

an image forming section disposed in the apparatus main body;

a sheet-of-paper discharging section disposed in an upper portion of the apparatus main body, for discharging a recording sheet on which an image is formed by the image forming section, to an outside of the apparatus main body; and an intermediate conveying path disposed above the image forming section and on the apparatus main body, for conveying the recording sheet from the sheet-of-paper discharging section to an after-treatment unit to be mounted on a side of the apparatus main body, the apparatus having such a structure that a recording-sheet accommodating unit having a sheet-of-paper discharging tray, or a document reading apparatus is allowed to be mounted above the apparatus main body, and further comprising:

a conveying path cover disposed so as to be slidable on a top face and front face of the apparatus main body, for covering at least part of the intermediate conveying path.

5. The image forming apparatus of claim 1, wherein at least part of the conveying path cover comprises a transparent member.

6. The image forming apparatus of claim 4, wherein at least part of the conveying path cover comprises a transparent member.

* * * * *